US006330866B1

(12) United States Patent
Cipolla

(10) Patent No.: US 6,330,866 B1
(45) Date of Patent: Dec. 18, 2001

(54) MISSILE SUPPORT AND ALIGNMENT ASSEMBLY

(75) Inventor: Jeffrey L. Cipolla, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/090,222

(22) Filed: May 22, 1998

(51) Int. Cl.[7] ..... B63B 5/00

(52) U.S. Cl. ..... 114/238; 114/316; 89/1.801

(58) Field of Search ..... 89/1.81, 1.815, 89/1.801–1.805, 33.02, 34, 1.8; 114/238, 317, 318, 337, 23, 22, 21.1

(56) References Cited

U.S. PATENT DOCUMENTS

| | | | | |
|---|---|---|---|---|
| 2,546,823 | * | 3/1951 | Holloway | 89/1.801 |
| 2,792,757 | * | 5/1957 | Carlberg et al. | 89/1.802 |
| 2,807,193 | * | 9/1957 | Robert et al. | 89/1.803 |
| 2,903,124 | * | 9/1959 | Carver | 89/1.801 |
| 2,908,200 | * | 10/1959 | Linke | 89/1.803 |
| 2,968,410 | * | 1/1961 | Hamilton et al. | 89/1.805 |
| 2,984,157 | * | 5/1961 | Johnstone | 89/1.802 |
| 2,995,986 | * | 8/1961 | Carlberg | 89/1.802 |
| 2,997,923 | * | 8/1961 | Kempton | 89/1.804 |
| 3,135,162 | * | 6/1964 | Kamalian | 89/1.81 |
| 3,162,088 | * | 12/1964 | Landstrom | 89/1.802 |
| 3,316,808 | * | 5/1967 | Mais | 89/1.804 |
| 3,857,321 | * | 12/1974 | Cohen | 89/1.81 |
| 4,128,039 | * | 12/1978 | Skliris | 89/1.803 |
| 4,409,880 | * | 10/1983 | Fetterly | 89/1.804 |
| 4,444,087 | * | 4/1984 | Hunter et al. | 89/1.802 |
| 4,586,421 | * | 5/1986 | Hickery et al. | 89/1.81 |
| 4,700,653 | * | 10/1987 | Harris et al. | 114/316 |
| 4,840,110 | * | 6/1989 | Fischer | 89/46 |
| 4,854,260 | * | 8/1989 | Woidich et al. | 114/316 |
| 5,438,906 | * | 8/1995 | Huber | 89/1.81 |
| 5,445,104 | * | 8/1995 | Moody | 114/316 |
| 5,877,696 | * | 3/1999 | Powell | 340/825 |

FOREIGN PATENT DOCUMENTS

| | | | | |
|---|---|---|---|---|
| 220879 | * | 4/1910 | (DE) | 114/316 |
| 14883 | * | 10/1923 | (DE) | 114/316 |
| 344057 | * | 10/1936 | (IT) | 114/316 |

* cited by examiner

*Primary Examiner*—Michael J. Carone
*Assistant Examiner*—Denise J. Buckley
(74) *Attorney, Agent, or Firm*—Michael J. McGowan; Prithvi C. Lall; Michael F. Oglo

(57) ABSTRACT

A missile support and alignment assembly for use on a moving vehicle having a fixed missile launch tube mounted thereon. The assembly comprises a missile support assembly including (i) a loading tray for supporting a missile, (ii) a storage structure for supporting the loading tray, and (iii) mounts resiliently connecting the storage structure to the vehicle. The missile support and alignment assembly further comprises an alignment assembly including (i) indicator means on the launch tube, (ii) a sensor on the tray for reading a position of the indicator means, the sensor being adapted to send a signal indicative of position of the tray, and thereby a missile on the tray, relative to the indicator means, and thereby the launch tube, (iii) a control device adapted to receive the sensor signals and compute movement of the tray necessary to align the missile with the launch tube, the control device being adapted to send corrective signals, and (iv) alignment motors mounted on the storage structure for receiving the control device signals and for moving the tray relative to the launch tube to bring the missile in the tray into alignment with the launch tube.

8 Claims, 1 Drawing Sheet

MISSILE SUPPORT AND ALIGNMENT ASSEMBLY

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to missile launch systems and is directed more particularly to a missile support and alignment assembly for use on a moving vehicle, such as a submarine, having a fixed missile launch tube.

(2) Description of the Prior Art

Submarines are provided with fixed launch tubes for torpedoes and other missiles and ordnance. The tubes penetrate the pressure hull of the vessel. The launch tubes are arranged in a manner consistent with safety, the architecture of the vessel, and watertight integrity. Proximate the tubes is disposed an arrangement of shelf or frame-like structures for storage of the missiles and/or other ordnance, and a handling system for selecting a weapon, aligning the selected weapon with a selected launch tube, and for feeding the selected weapon into the selected launch tube.

Because of the length-to-diameter ratio of the weapons, and their relative fragility, tolerance on the alignment of weapon and tube during loading is critical. Consequently, current designs for storage, handling and loading systems employ structures securely fixed to the hull, and are aligned with the launch tubes during construction. Such structures do not themselves provide significant shock and acoustic isolation from the hull. Accordingly, considerable effort and expense is devoted to design and analysis of the rigidly fixed structure and to partially isolating substructures to ensure adequate vibration and acoustic isolation. There is, accordingly, a need for a missile support assembly which is resiliently mounted in the submarine so as to "float" relative to the hull.

It is apparent that such a "floating" structure would not maintain a supported missile in alignment with a launch tube at all times. There is accordingly a further need for an alignment assembly which is operative on such a "floating" support to align a missile with a launch tube.

SUMMARY OF THE INVENTION

It is, therefore, an object of the invention to provide a missile support system for a vehicle having a fixed missile launch tube, the system including a missile support which is fixed to the vehicle by resilient mounts which permit the missile support to move relative to the vehicle.

It is a further object of the invention to provide a missile alignment system for use in conjunction with the aforementioned missile support system for aligning a missile retained by the missile support with the fixed missile launch tube, such that the missile may be pushed into the launch tube.

With the above and other objects in view, as will hereinafter appear, a feature of the present invention is the provision of a missile support assembly for use on a vehicle having a fixed missile launch tube, the assembly comprising a loading tray for supporting a missile, a storage structure for supporting the loading tray, and mounts resiliently connecting the storage structure to the vehicle.

In accordance with a further feature of the invention, there is provided a missile alignment assembly for use on a vehicle having a fixed missile launch tube, and in conjunction with a missile support assembly resiliently mounted on the vehicle, the alignment assembly comprising indicator means on the launch tube, a missile retaining tray mounted on the support assembly, at least one sensor on the missile retaining tray for reading a position of the indicator means, the sensor being adapted to send a signal indicative of the position of the tray, and thereby a missile retained by the tray, relative to the indicator means, and thereby the launch tube, a control device adapted to receive the sensor signals and compute movement of the tray necessary to align the missile with the launch tube, the control device being operative to send corrective signals, and alignment means mounted on the missile support assembly for receiving the corrective signals from the control device and operative in response thereto to move the tray widthwise of the launch tube to bring the missile on the tray into alignment with the launch tube.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawing s and wherein.

DESCRIPTION OF THE PREFERRED EMBODIMENT

Figure 1:
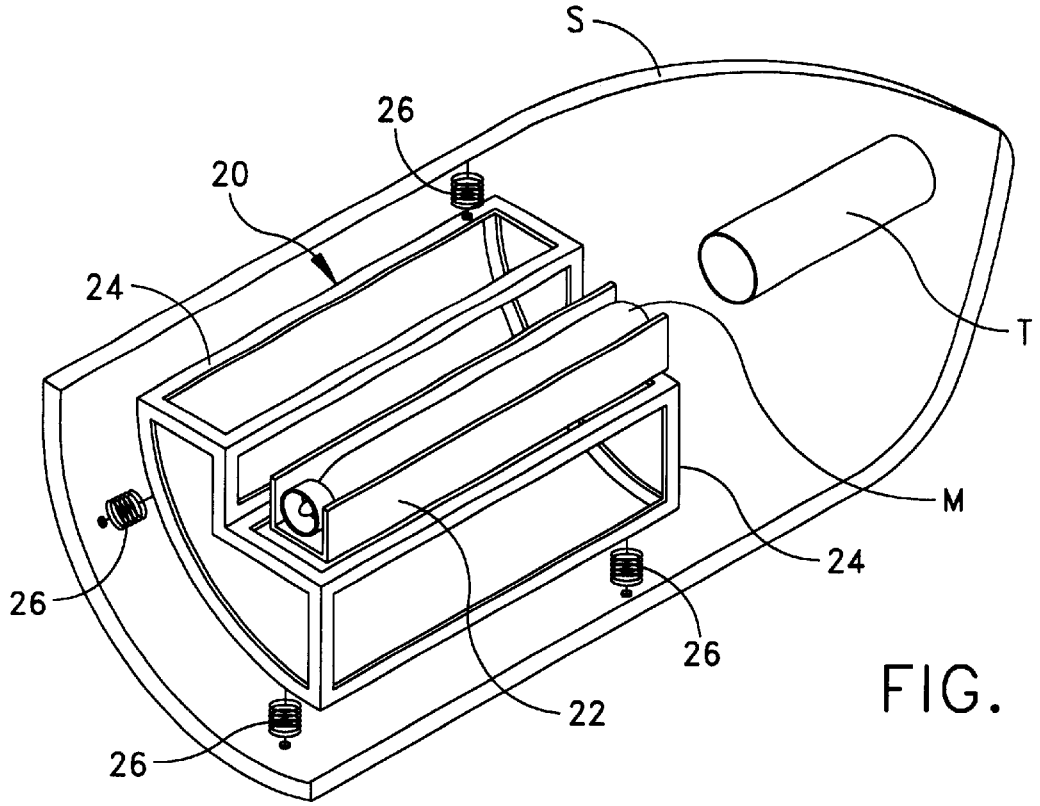
FIG. 1 is a diagrammatic perspective view of one form of a missile support assembly illustrative of an embodiment of the invention.

Referring to FIG. 1, it will be seen that a preferred storage structure assembly 20 includes a loading tray 22 for supporting a missile M for alignment with a launch tube T. The tray 22 is supported by a frame structure 24 which is resiliently connected to a submarine, or other vehicle S, by mounts 26.

Figure 2:
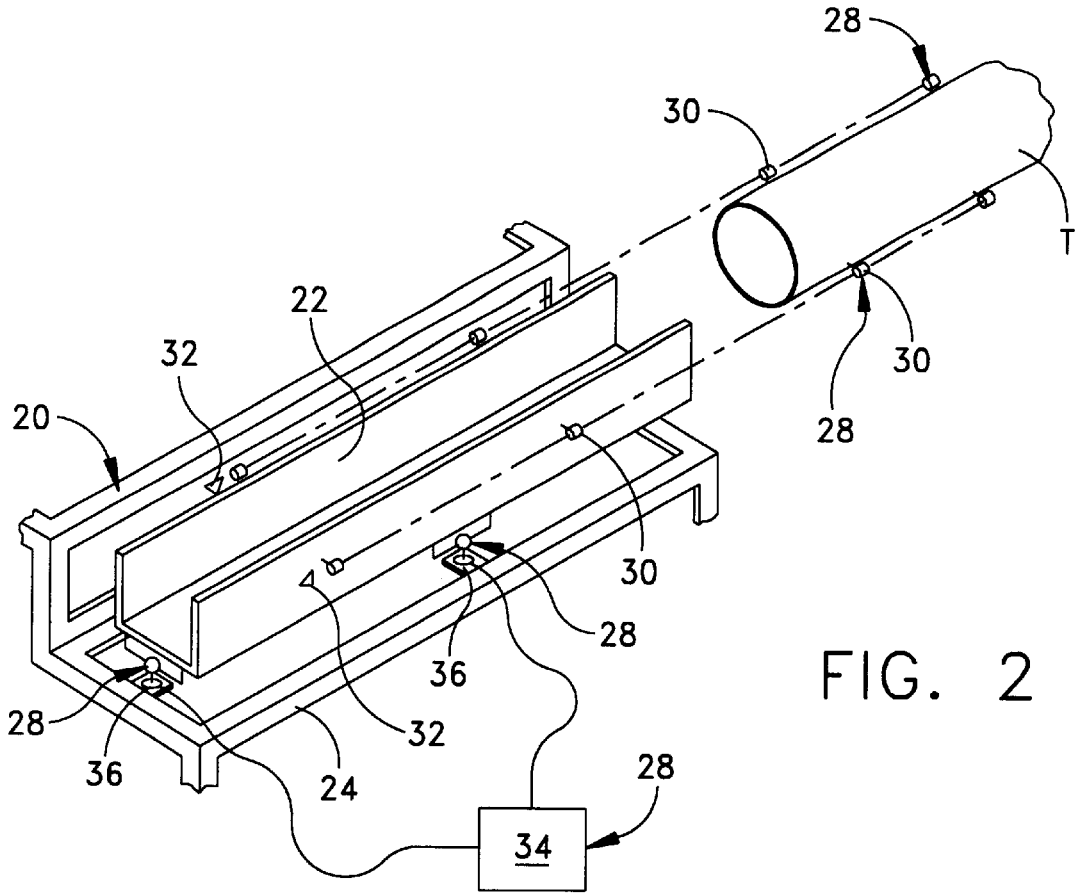
FIG. 2 is similar to FIG. 1, but illustrative of an alignment assembly mounted on the support assembly of FIG. 1.

Referring to FIG. 2, it will be seen that a preferred alignment assembly 28 includes indicator means 30 on launch tube T and tray 22, and sensor means 32 on tray 22. Each sensor means 32 is adapted to read at least one target indicator means 30 and to send a signal indicative of the position of the indicator means relative to the sensor means, and thereby the position of launch tube T relative to missile M.

The indicator means 30 may be in the form of markings or structure, such as fins or pins, or the like, on the launch tube T and, optionally, on tray 22, or active optical or electromagnetic emitters, such as light beam emitters, or the like, on the launch tube and/or tray. The sensor means 32 are adapted to read the markings or target structure, or a beam emitted by a beam emitter.

The alignment assembly 28 further includes a control device 34 which is adapted to receive signals from the sensors 32 and compute or otherwise indicate movement of tray 22 necessary to align missile M with launch tube T. Further included in alignment assembly 28 are alignment motors 36 mounted on frame structure 24 for moving tray 22 to align missile M with launch tube T. The alignment motors 36 may be configured to receive corrective signals directly from control device 34 and in response thereto move the tray as appropriate to align missile M with launch tube T. Alternatively, control device 34 may provide an indication to a human operator who performs final alignment of missile M and tube T by manual control of alignment motors 36.

In operation, when it is desired to initiate a missile launch, the alignment assembly 28 is energized. The sensors 32 signal control device 34 as to the position of tube T, relative to missile M. The control device 34 computes movement of tray 22 required to align missile and tray and sends signals to alignment motors 36 instructing the required movements. The alignment motors 36 operate to move tray 22 to bring the missile M into alignment with the launch tube T. A ram means (not shown), well known in the art, moves the missile axially into the launch tube. The alignment assembly 28 operates continuously from energization to launch tube loading to maintain proper alignment between missile M and launch tube T.

Alternatively, control device 34 provides a continuous indication of the required movements to a human operator. The operator manually controls alignment motors 36 to align missile M and launch tube T.

There is thus provided a missile support assembly which is resiliently mounted in a submarine or other vehicle, and an alignment assembly operative to align a missile resting on the support assembly with a launch tube.

It will be understood that many additional changes in the details, materials, steps and arrangement of parts, which have been herein described and illustrated in order to explain the nature of the invention, may be made by those skilled in the art within the principles and scope of the invention or expressed in the appended claims. For example, while in the above description the use of the assembly described herein is set forth with regard to submarines, and while it is contemplated that the assembly will find substantial use in submarines, it will be apparent that the invention has applications in other marine vehicles, air transport vehicles, and in land-based vehicles, such as railroad cars having launch tubes mounted thereon, or where alignment between separately supported structures is critical and the alignment is subject to movement of the structures relative to one another.

What is claimed is:

1. A missile support assembly for use on a vehicle having a fixed missile launch tube, the assembly comprising:

a loading tray for supporting a missile in line axially with the launch tube;

a frame comprising a skeletal structure for supporting said loading tray such that said loading tray is moveable in directions off-set from a central axis of the missile; and mounts resiliently connecting said frame skeletal structure to the vehicle to permit said frame structure to springingly float relative to the vehicle.

2. The assembly in accordance with claim 1, wherein said assembly further comprises means for aligning the missile with the launch tube.

3. The assembly in accordance with claim 2 wherein said aligning means comprises at least one indicator disposed on the launch tube, and at least one sensor disposed on the tray for determining a position of said sensor relative to said indicator, and thereby a position of the missile relative to the launch tube.

4. The assembly in accordance with claim 3 wherein:

said sensor is adapted to send a signal indicative of the position of the missile relative to the launch tube; and said assembly further comprises a control device adapted to receive said sensor signal and compute movement of the missile necessary to align the missile with the launch tube.

5. The assembly in accordance with claim 4 wherein:

said control device is adapted to send a signal indicative of the movement of the missile necessary to align the missile with the launch tube; and said aligning means further comprises motor means mounted on said frame structure and responsive to said control device signal to move said tray to place the missile in alignment with the launch tube.

6. The assembly in accordance with claim 4 wherein:

said control device is adapted to send a signal indicative of the movement of the missile necessary to align the missile with the launch tube; and said aligning means further comprises motor means mounted on said frame structure and manually operative in response to said signal to move said tray to place the missile in alignment with the launch tube.

7. A missile alignment assembly for use on a vehicle having a fixed missile launch tube, and in conjunction with a missile support assembly resiliently mounted on the vehicle and a missile retaining tray mounted on said support assembly, the alignment assembly comprising:

indicator means on the launch tube;

at least one sensor on said missile retaining tray for reading a position of said indicator means, said sensor being adapted to send a signal indicative of a position of said tray, and thereby a missile retained by said tray, relative to said indicator means, and thereby said launch tube;

a control device adapted to receive said sensor signal and compute movement of said tray necessary to align the missile with the launch tube, said control device being adapted to send corrective signals; and alignment means mounted on the missile support assembly for receiving said corrective signals from said control device and operative in response thereto to move said tray to bring the missile on said tray into alignment with the launch tube.

8. A missile support assembly for use on a vehicle having a fixed missile launch tube, the assembly comprising:

a loading tray for supporting a missile in line axially with the launch tube;

a frame comprising a skeletal structure for supporting said loading tray such that said loading tray is moveable in directions off-set from a central axis of the missile;

mounts resiliently connecting said frame skeletal structure to the vehicle to permit said frame structure to springingly float relative to the vehicle; and means for aligning the missile with the launch tube, said aligning means comprising at least one indicator disposed on the launch tube, and at least one sensor disposed on the tray for determining a position of said sensor relative to said indicator, and thereby a position of the missile relative to the launch tube.

* * * * *